United States Patent [19]

Quinn

[11] Patent Number: 4,739,911

[45] Date of Patent: Apr. 26, 1988

[54] MANNEQUIN FOR DISPLAYING A GARMENT

[75] Inventor: Karen M. Quinn, Melville, N.Y.

[73] Assignee: Trim Corporation of America, New York, N.Y.

[21] Appl. No.: 3,742

[22] Filed: Jan. 16, 1987

[51] Int. Cl.[4] ..... A41D 27/22

[52] U.S. Cl. ..... 223/85; 223/66; 223/92; 40/322

[58] Field of Search ..... 223/85, 92, 66, 68, 223/69, 72; 40/322

[56] References Cited

U.S. PATENT DOCUMENTS

| | | | |
|---|---|---|---|
| 201,778 | 7/1965 | Berman . | |
| 1,096,018 | 5/1914 | Buchwald | 223/92 |
| 1,119,087 | 12/1914 | McCarrell . | |
| 1,591,786 | 7/1926 | Simpson | 223/66 X |
| 1,617,676 | 2/1927 | Dobbin . | |
| 1,833,503 | 11/1931 | Sumner . | |
| 1,951,985 | 3/1934 | Likly . | |
| 2,013,395 | 9/1935 | Wood . | |
| 2,169,552 | 8/1939 | Bellin . | |
| 2,233,492 | 3/1941 | Sperry . | |
| 2,315,371 | 3/1943 | Kahn . | |
| 2,410,230 | 10/1946 | Parker, Jr. . | |
| 2,657,842 | 11/1953 | Smith . | |
| 2,710,489 | 6/1955 | Myers, Jr. . | |
| 2,751,071 | 6/1956 | Goldband . | |
| 3,010,225 | 11/1961 | Hale | 223/66 X |
| 3,126,237 | 3/1964 | Kirk | 223/85 X |
| 3,205,614 | 9/1965 | Brosk | 223/92 X |
| 3,269,054 | 8/1966 | Taylor . | |
| 3,346,879 | 10/1967 | Buzzelli | 223/85 X |
| 4,542,838 | 9/1985 | Perez-Tubens et al. | 223/85 X |
| 4,563,373 | 1/1986 | Barnett | 223/85 X |

*Primary Examiner*—Louis K. Rimrodt
*Assistant Examiner*—J. L. Olds
*Attorney, Agent, or Firm*—Stiefel, Gross & Kurland

[57] ABSTRACT

A mannequin for the display of clothing is disclosed. Mannequin comprises a body portion and a means on the body portion, such as a hook, for suspending a garment hanger on the mannequin. The suspending means is positioned on the mannequin such that when the hanger, together with the garment to be displayed, is suspended on the mannequin, the mannequin appears to be wearing the garment.

14 Claims, 2 Drawing Sheets

FIG. 2
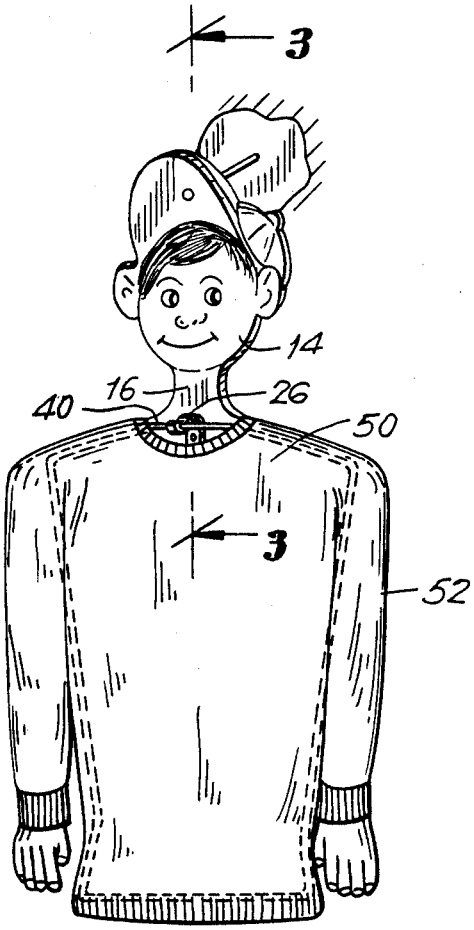
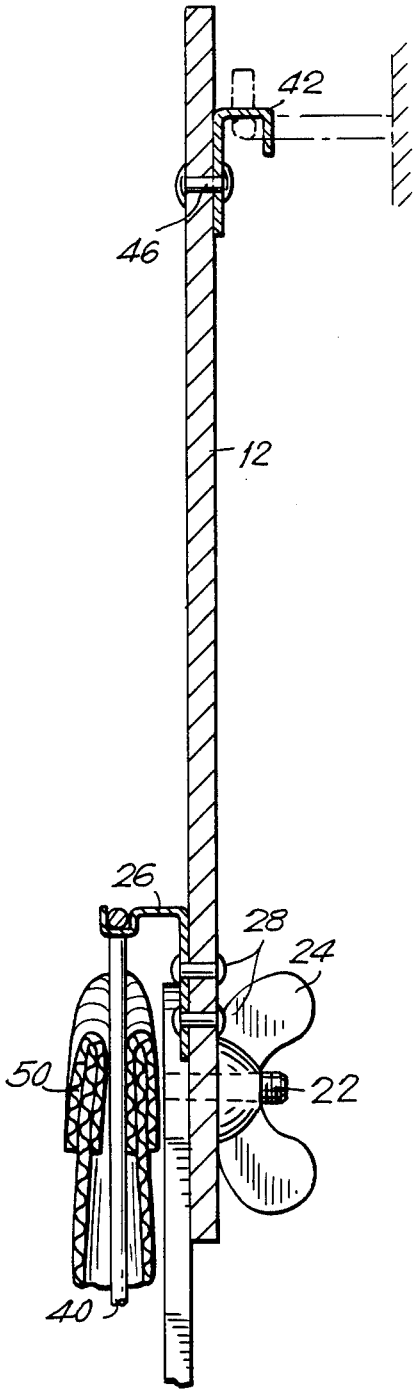
FIG. 3

MANNEQUIN FOR DISPLAYING A GARMENT

BACKGROUND OF THE INVENTION

1. Field Of The Invention

This invention relates to mannequins. More particularly, it relates to mannequins used for the display of clothing.

2. Description of Related Art

Mannequins have long been used for the display of clothing to promote customer interest and sales. Usually these mannequins are three-dimensional. In order to display the particular garment, the mannequin is actually dressed with the garment. If a different garment is to be displayed on the mannequin, then it is necessary to first undress the mannequin and remove the previous garment, and thereafter to dress the mannequin with the new garment. This dressing, undressing, and redressing of the mannequin is cumbersome and time consuming.

Although three-dimensional mannequins are most frequently used for clothing displays, mannequins that are essentially flat are also known. See, e.g., Berman U.S. Pat. No. Des. 201,778, Sumner U.S. Pat. No. 1,833,503, and Wood U.S. Pat. No. 2,013,395. As with the three-dimensional mannequins, however, here too it is necessary to actually clothe the mannequin with the garment that is to be displayed, so that when it is desired to use the mannequin to display a different garment display, time must be taken to undress the mannequin and to remove the original garment and then dress the mannequin in the new garment.

SUMMARY OF THE INVENTION

The invention provides a mannequin for easily and conveniently displaying a garment. The mannequin comprises a body portion together with means on the body portion, e.g., a hook mounted to the body portion, for suspending a garment hanger on the mannequin. The securing means is so positioned on the body portion that when a garment is hung on the hanger and the hanger with garment is suspended on the mannequin, the mannequin appears to be clothed with the garment.

BRIEF DESCRIPTION OF THE DRAWINGS

My invention will be best understood by reference to the following detailed description taken in conjunction with the accompanying drawings wherein:

FIG. 2 is a perspective view of the mannequin in use, displaying a garment which the mannequin appears to be wearing; and FIG 3 is a partially expanded cross-sectional view taken substantially along the line 3—3 of FIG. 2.

DESCRIPTION OF THE PREFERRED EMBODIMENT

Figure 1:
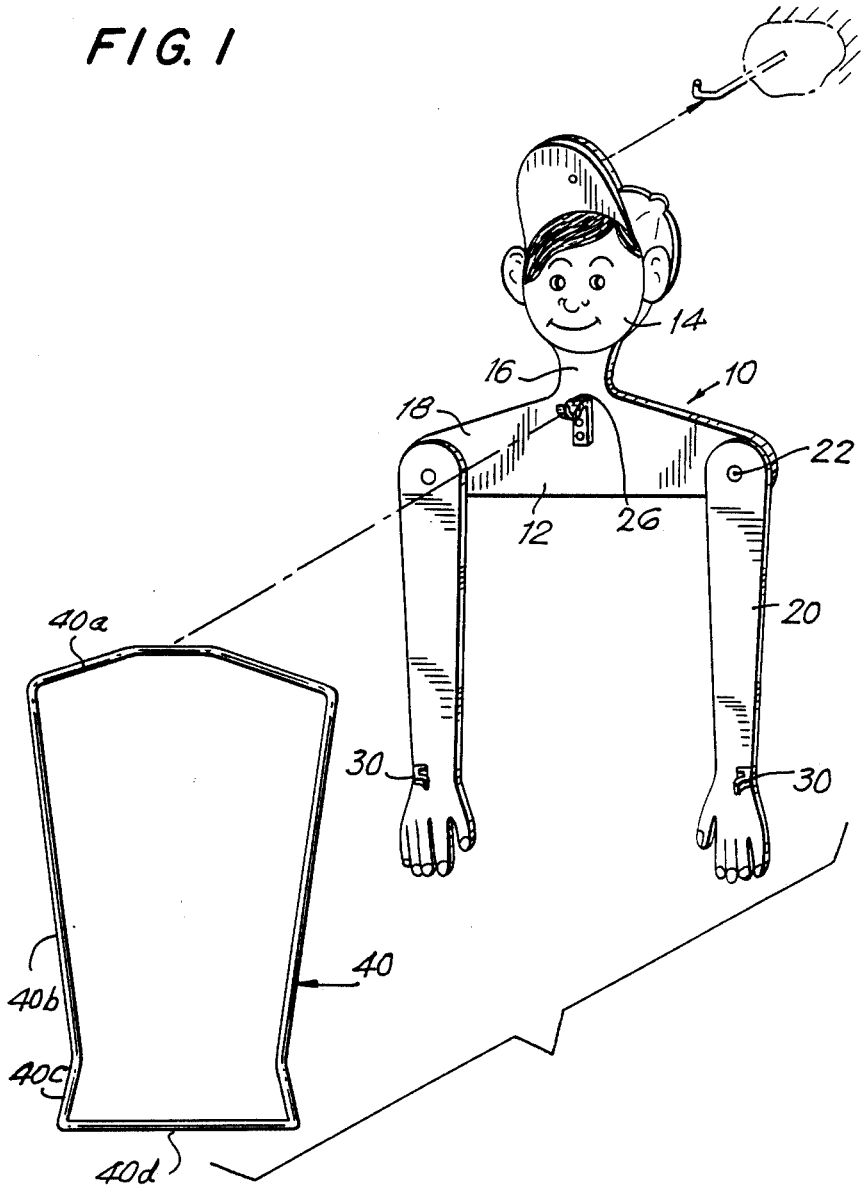
FIG. 1 is an exploded perspective view of one embodiment of the mannequin of my invention.

Referring to FIG. 1, a mannequin in accordance with my invention is generally illustrated by the reference numeral 10. The mannequin 10 comprises a body portion 12 made of any suitable rigid material such as wood or plastic. The body portion desirably includes a head 14, neck 16, shoulders 18, and arms 20. As shown in FIGS. 1 and 2, the front of the body portion, particularly the head, preferably has human features, which may be painted, drawn, or imprinted thereon.

Preferably, and as illustrated in the drawings, each arm 20 is pivotally mounted to a shoulder 18, as by means of a bolt 22 and wing nut 24. The arms are thus pivotable about bolt 22 to any desired position. Each arm can be fixed in any desired position, e.g., extending down by the side, extending outwardly, extending upwardly, or the like, by the simple expedient of loosening and tightening the wing nut 24. Of course, if desired, the arms may be integral with the shoulders, in permanently fixed positions, rather than being pivotally mounted therein.

Suitable means for releasably securing a garment hanger to the front (or rear) of the mannequin are provided. Preferably, and as shown, the releasable securing means comprises a hook 26, the hook and mounted to the body portion 12, as by pop rivots 28. As best seen in FIG. 3, the hook 26 extends slightly outwardly from the front surface of the body portion 12, so that a hanger can readily be hung from the hook. In the embodiment shown, the hook is positioned at the neck of body portion 12.

While various forms of garment hangers may be used, in accordance with the invention a preferred hanger is illustrated in FIG. 1 and identified by the reference numeral 40. As shown, upper members **40*a* are contoured to provide a support for the particular garment to be displayed, e.g., a blouse, robe, shirt, sweater, or the like. The upper sides 40*b* extend downwardly and taper inwardly to conform to the shape of the chest. The lower sides 40*c* extend downwardly from the waist and flare slightly outwardly to define the hips, so that a suitable garment, e.g., a skirt or slacks, can be hung from the waist portion of the hanger. The bottom 40*d*** completes the integral hanger.

As shown in FIG. 1, each arm 20 of the mannequin 10 may desirably be provided with means, e.g., one or more clips 30, for releasably securing to the arm the sleeve of a garment that is to be displayed.

In using the mannequin of my invention, the particular garment to be displayed, e.g., a sweater, is hung on the hanger 40. The hanger (with the sweater 50 on it) is then hung on hook 26. The sweater sleeves 52 may be secured to the mannequin arms 20, as by clips 30. Preferably, each clip is adapted to clamp the rear portion of the sweater sleeve, so that the clips are hidden by the sleeves when the sweater is displayed on the mannequin. Accordingly, when one looks at the mannequin from the front, the mannequin appears to be wearing the sweater 50, as illustrated in FIG. 2.

A "change of clothing" for the mannequin is effected easily and quickly. If the mannequin previously was "wearing" a sweater and it is now desired to instead display a shirt, the hanger with the sweater is simply removed from hook 26 and another hanger with the desired shirt is substituted. Alternatively, the sweater on the original hanger is simply replaced with the shirt.

The mannequin of my invention is particularly suited for displaying childrens' garments. For such purpose the mannequin preferably includes a child's head 14 as a part thereof (FIG. 1). The child's head in combination with the substantially flat, two-dimensional body of the "dressed" mannequin is esthetically appealing to children.

In order to permit the mannequin to be hung on a support for display purposes, it is desirable to provide suitable releasable securing means. For example, and as best seen in FIG. 3, a hook 42 may be provided on the rear side of the mannequin at the back of the head. The hook is secured to the mannequin by any conventional means, for instance, by a nut 44 and bolt 46 as (FIG. 3). By virtue of this construction, the dressed mannequin can be hung for display from a support such as a wall or grid (not shown). Alternatively or additionally, the mannequin may be provided with an integral or releasable base to permit a free-standing display.

Although FIGS. 1 and 3 illustrate hooks 26 and 42 as the releasable securing means for the hanger 40 and mannequin 10, respectively, it will be apparent that any releasable securing means can be used. For example, in lieu of hook 26, "Velcro" could be employed, with one "Velcro" strip being glued to the mannequin and the mating "Velcro" strip being glued to the hanger.

Although the mannequin illustrated in FIG. 1 comprises the upper portion of a human body, it is to be understood that my invention also comprehends a mannequin comprising an entire body, or a mannequin made up of an intermediate body portion, or a mannequin made up of the lower portion of the body for displaying a garment such as a skirt, trousers, or the like.

Having thus described the invention, what is desired to be secured and claimed by Letters Patent is:

1. A mannequin for displaying a garment, said mannequin comprising a body portion and means on said body portion for releasably securing a hanger thereto, said releasable securing means being so disposed on said body portion that when a garment is hung on said hanger and said hanger with garment is releasably secured to said body portion, the mannequin appears to be clothed with the garment.

2. The mannequin of claim 1, wherein said body portion includes a head, neck, shoulders, and arms.

3. The mannequin of claim 2, wherein each arm is pivotably connected to its respective shoulder.

4. The mannequin of claim 3 additionally comprising means for fixing said arms in a desired position.

5. The mannequin of claim 4, additionally comprising means on said arms for releasably securing the sleeves of a garment thereto.

6. The mannequin of claim 1 additionally comprising releasable mounting means on said body portion for mounting said mannequin to a support.

7. The mannequin of claim 1, wherein said releasable securing means comprises a hook mounted to said body portion.

8. A mannequin-garment display comprising (a) a mannequin body portion, (b) means on said body portion for releaseably securing a hanger thereto, (c) a hanger, and (d) a garment hung on said hanger, said hanger with said garment thereon being releaseably secured to said body portion, and said releaseable securing means being so disposed on said body portion that said mannequin appears to be clothed with said garment.

9. The display of claim 8, wherein said body portion includes a head, neck, shoulders, and arms.

10. The display of claim 9, wherein each arm is pivotably connected to its respective shoulder.

11. The display of claim 10, additionally comprising means for fixing said arms in a desired position.

12. The display of claim 11, wherein said garment includes sleeves, said display additionally comprising means on said arms for releasably securing the sleeves of said garment to said arms.

13. The display of claim 8, additionally comprising releasable mounting means on said body portion for mounting said display to a support.

14. The display of claim 8, wherein said releasable securing means comprises a hook mounted to said body portion.

* * * * *